US006139450A

United States Patent [19]

Rivers

[11] Patent Number: 6,139,450

[45] Date of Patent: Oct. 31, 2000

[54] SYSTEM FOR TRAINING A PITCHER TO PITCH A BASEBALL

[76] Inventor: Gary M. Rivers, Rte. 11, Box 140, Hendersonville, N.C. 28792

[21] Appl. No.: 09/344,910

[22] Filed: Jun. 26, 1999

[51] Int. Cl.[7] ..... A63B 69/00

[52] U.S. Cl. ..... 473/422; 473/497; 482/146

[58] Field of Search ..... 473/497, 453, 473/454; 482/51, 52; 248/127

[56] References Cited

U.S. PATENT DOCUMENTS

| | | | |
|---|---|---|---|
| 1,661,805 | 3/1928 | Lentaty | 248/127 |
| 2,189,428 | 2/1940 | Love | 473/497 |
| 3,313,505 | 4/1967 | Petrie | 248/165 |
| 4,846,471 | 7/1989 | Haysom . | |
| 5,213,323 | 5/1993 | Novinsky | 473/451 |
| 5,333,856 | 8/1994 | Gery | 473/454 |
| 5,496,248 | 3/1996 | Batscher | 482/146 |
| 5,553,846 | 9/1996 | Frye et al. . | |
| 5,651,753 | 7/1997 | Wilkinson | 482/52 |

*Primary Examiner*—Jeanette Chapman
*Assistant Examiner*—Mitra Aryanpour
*Attorney, Agent, or Firm*—Joseph T. Guy

[57] ABSTRACT

The present invention details a system for training a baseball pitcher to properly position a drive leg and a lead leg at the middle of the delivery. The system comprising: a support base. A vertically adjustable support arm is attached to said support base. A stirrup is attached to the vertically adjustable support arm. The device is adjustable so that the stirrup can be positioned to allow the pitcher to place a lead foot of the lead leg in the stirrup while the lead leg forms a right angle. The stirrup allows the lead foot to slide in direction of a target.

19 Claims, 5 Drawing Sheets

SYSTEM FOR TRAINING A PITCHER TO PITCH A BASEBALL

BACKGROUND OF THE INVENTION

The present invention is related to a system for training a baseball pitcher the proper motions necessary to pitch a baseball towards a target with precision and velocity.

Baseball is a widely played and very popular sport for all ages. It is most common for children to play this sport as a team activity starting from as early as 5 years of age continuing well into high school, college or even as a professional. One of the most critical positions in baseball is that of the pitcher. Pitching proficiency requires precision and a consistent motion beginning with the setup, through the mid-delivery point and into the follow through. Each part of the pitching motion builds from the previous part and it is therefore important that the set up is proper to allow for a proper mid delivery point and so on.

Teaching a beginning pitcher the proper motion is difficult and even at the highest level of competition the lack of teaching aids is apparent. The set-up position is static since it is the point from which motion begins. This can be taught simply by placing the feet, legs, arms and torso in the proper position. Teaching the mid delivery point is difficult because the pitcher does not stop at this point and it is only through repeated trial and error, coupled with reinforcement from a coach, that the mid delivery positions and motion are developed. The motion from the mid delivery position through completion of the pitch is critical in determining the accuracy and velocity of a pitched ball.

A pitcher can be placed in the mid delivery position but this requires balancing on the drive leg while holding the lead leg in the air. This is uncomfortable and the proper balance is difficult to maintain since the momentum associated with a full speed pitch is missing. This method has not proven to be effective.

It is the purpose of the present invention to provide a training device which allows a pitcher to be placed in the mid delivery position comfortably. The training device allows the player to practice the pitching motion from the mid delivery position to follow through and to completion or to practice the motion from set up to the mid delivery postion independently.

SUMMARY OF THE INVENTION

It is an object of the present invention to provide a system for teaching a pitcher to properly pitch a baseball towards a target.

It is another object to provide a method for teaching a pitcher the proper motion for pitching and an apparatus to reinforce the proper motion.

A particular feature of the present invention is the ability to isolate the pitching motion from set up to mid delivery position from the follow through.

Another particular feature of the present invention is the ability to start the motion at the mid delivery position to allow the pitcher to work on the motion from mid delivery to follow through without the set up.

These and other features are provided in a system for training a baseball pitcher to properly position a drive leg and a lead leg at the middle of the delivery. The system comprising: a support base. A vertically adjustable support arm is attached to the support base. A stirrup is attached to the vertically adjustable support arm. The device is adjustable so that the stirrup can be positioned to allow the pitcher to place a lead foot of the lead leg in the stirrup while the lead leg forms a right angle. The stirrup allows the lead foot to slide in direction of a target.

Another embodiment of the present invention is provided in a method for practicing the proper positioning and movement of a lead leg, with an associated lead foot, and a drive leg, with an associated drive foot, while pitching a baseball towards a target. The method comprises the steps of: a) positioning the lead foot and the drive foot in a parallel relationship on a pitching rubber with both of the lead foot and the drive foot perpendicular to the pitching rubber; b) moving the lead foot away from the target to a relaxation position; c) moving to a mid-point position wherein the drive foot is parallel to the pitching rubber and the lead foot is lifted and placed on a mid position training device wherein the mid position training device comprises: a support base, a vertically adjustable support arm attached to the support base; and a stirrup attached to the vertically adjustable support arm wherein the stirrup is positioned to allow the pitcher to place a lead foot of the lead leg in the stirrup while the lead leg forms a right angle; and d) bending the drive leg and simultaneously sliding the lead leg towards the target.

Yet another embodiment is provided in a system for training a baseball pitcher a proper motion for a drive leg and a lead leg while pitching a baseball. The system comprises a target and a mid position training device. The target comprises a rectangular frame; a support member attached to the frame; and a mesh net attached to the rectangular base. The mid position training device comprises a support base. Attached to the support base is a vertically adjustable support arm. A stirrup is attached to the vertically adjustable support sleeve wherein the stirrup is positioned to allow the pitcher to place the lead foot of the lead leg in the stirrup while the lead leg forms a right angle. The stirrup allows the lead foot to slide in the direction of the target.

DETAILED DESCRIPTION OF THE INVENTION

Throughout the following description similar elements are numbered accordingly.

Figure 1:
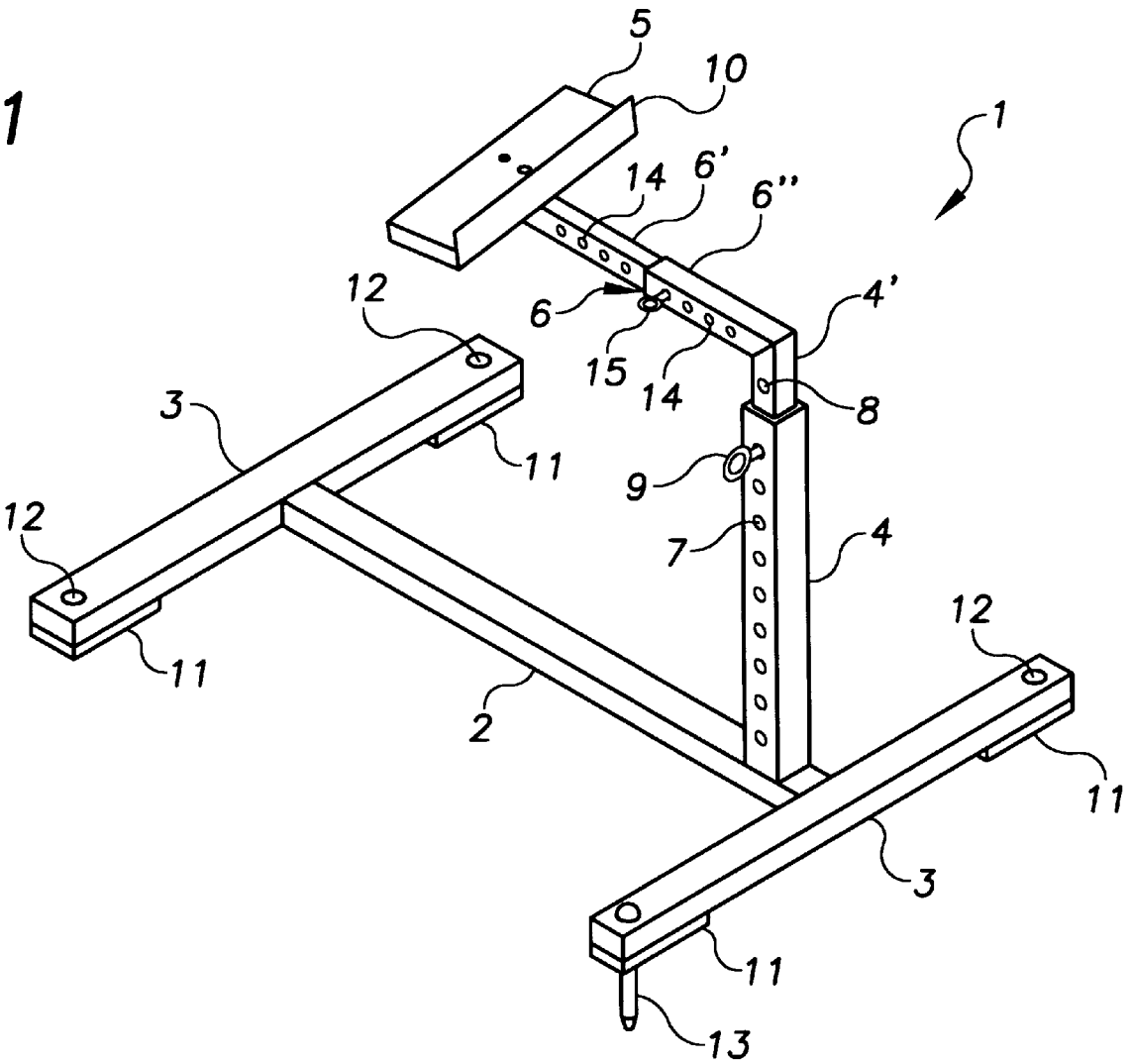
FIG. 1 is a perspective view of an embodiment of the mid position training device.

FIG. 1 is a perspective view of the mid position training device generally represented at 1. The mid position training device comprises a base preferably comprising a parallel base member, 2, which stabilizes the mid position training device in a direction parallel to the pitching direction and at least one base crossmember, 3, to stabilize the mid position training device in a direction perpendicular to the pitching direction. The base is preferably at least 12 inches long and no more than 36 inches long. Below a length of approximately 12 inches the stability is reduced and above a length of approximately 36 inches the apparatus becomes heavy and portability is decreased. Most preferred is a length of approximately 20 inches to approximately 30 inches. The most preferred length is approximately 24 inches since this is a reasonable compromise between the desire to be stable without sacrificing weight or portability.

Attached to the base is a vertically adjustable support arm comprising a fixed slide tube, 4, and at least one movable slide tube, 4'. The movable slide tube is slibably received in the fixed slide tube. The fixed slide tube and movable slide tube work in concert for raising or lowering the apparatus by matching outer adjustment holes, 7, with inner adjustment holes, 8, and inserting a pin, 9, therein to fix the position at a desired height. Other methods of vertically adjusting the height and reversibly fixing the position are known in the art and will not be expanded upon here. While the movable slide tube is illustrated as being interior to the fixed slide tube this orientation can be reversed without departing from the spirit or scope of the invention. The height of the vertically adjustable support arm is chosen based on the height, and leg length of the pitcher using the device. Preferably, the vertically adjustable support arm is at least 6 inches high and no more than approximately 36 inches. Most preferably, the vertically adjustable support arm is approximately, 8 inches to approximately 20 inches in height. Most preferred is a vertically adjustable support arm approximately 10 to approximately 14 inches in height.

Mounted on the movable slide tube is an optional stirrup extender, 6, with a stirrup, 5, attached thereto. In use, the pitcher will lift the lead leg and place the lead foot into the stirrup the proper positioning of which will be further explained herein. The stirrup extender, 6, optionally comprises an inner extender sleeve, 6', and an outer extender sleeve, 6". Each of the inner extender sleeve and the outer extender sleeve comprise adjustment holes, 14, which can be matched at various positions to move the stirrup in a direction parallel to the direction of the pitch by inserting a pin, 15, into the appropriate matched holes. The maximum length of the stirrup extender is preferably chosen to insure that the stirrup does not extend beyond the base. If the stirrup extends beyond the base then excessive weight could cause the mid position training device to be unstable which is undesirable. Most preferably, the length of stirrup extender is less than approximately 15 inches.

The stirrup, 5, is a platform which is parallel to the ground. The preferred size of the platform is at least approximately 3 inches in either direction to no more than approximately 10 inches in either direction. Most preferred is a platform size of approximately 4 inches by 5 inches. The size is selected to insure adequate area to place the lead foot but it should not be so large as to be difficult for the pitcher to slide the lead foot towards the target. An optional but preferred vertical wall, 10, is attached to the stirrup to protect the pitchers foot from sliding off of the stirrup. The stirrup is preferably metal with optional padding on the vertical wall or the stirrup itself.

Optional spacers, either fixed or removable, can be provided on the bottom of the base as further stabilizers or to level the device. At least one optional, but preferred stake, 13, can be inserted through stake holes, 12, to further stabilize the device.

Figure 2:
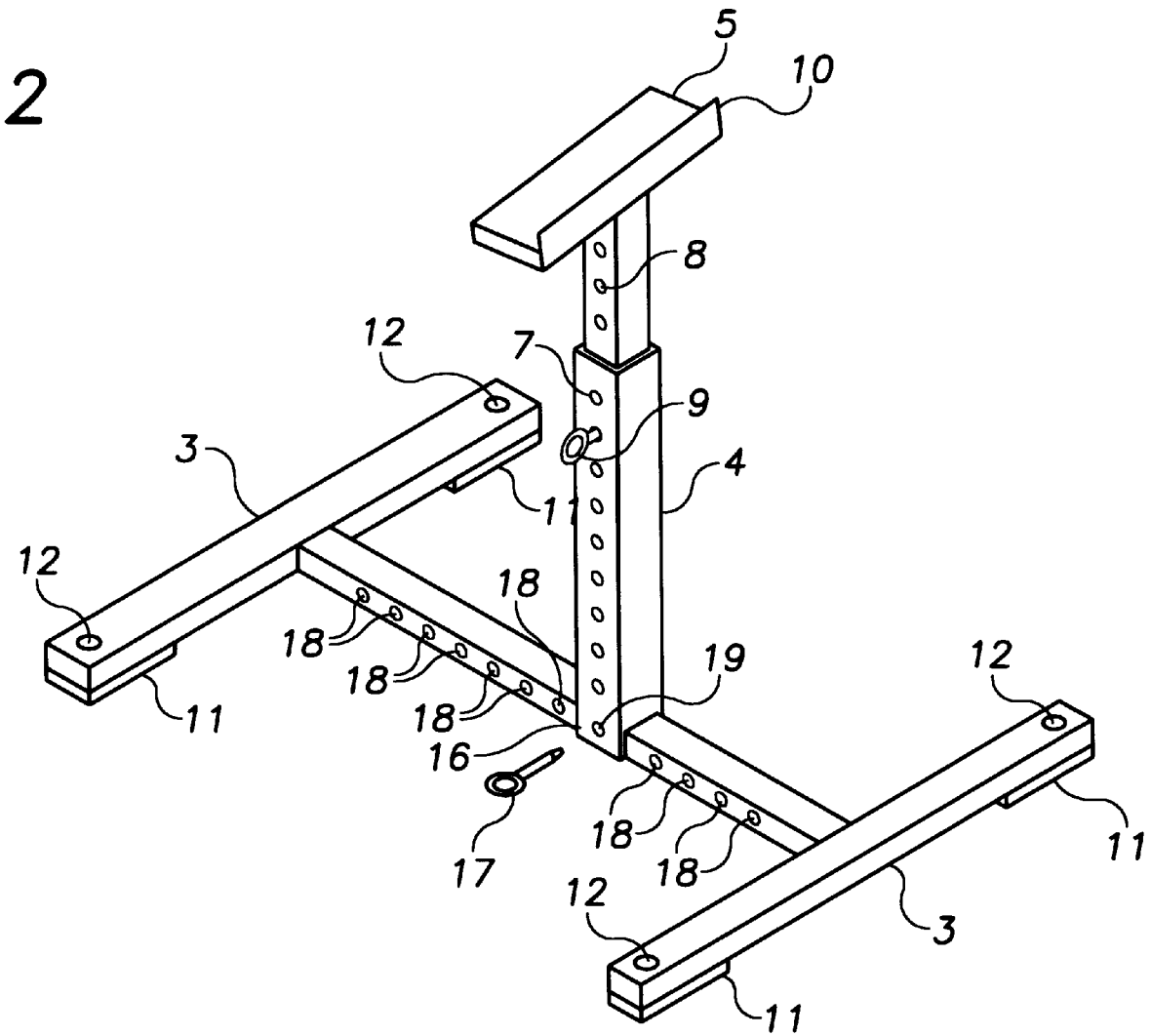
FIG. 2 is a perspective view of another embodiment of the mid position training device.

FIG. 2 is a second embodiment of the present invention. In the embodiment illustrated in FIG. 2 the stirrup is attached directly to the vertically adjustable support arm. The bottom of the vertically adjustable support arm is attached to a collar, 16, which slidably receives the parallel base member, 2. The stirrup can be moved along by aligning one of the alignment holes, 18, of the parallel base member with the alignment hole, 19, of the collar and inserting a pin, 17 in the aligned holes. The vertically adjustable support arm may also be rigidly attached to the base member, 2, if the ability to adjust the position of the stirrup along the center line is not desired.

Figure 3:
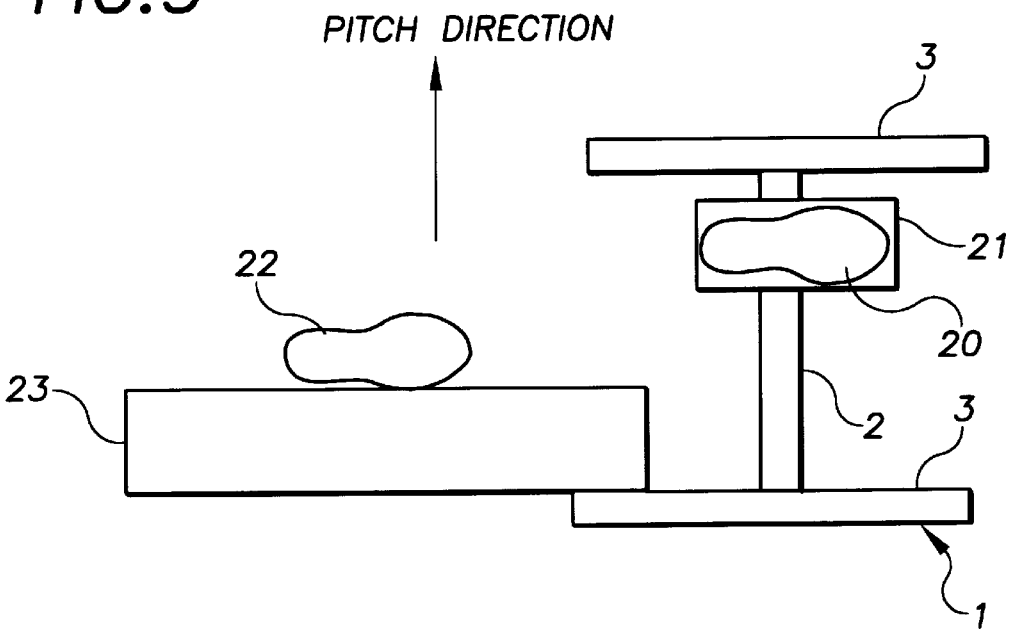
FIG. 3 is a top view illustrating the positioning of the mid delivery training device in use.
Figure 4:
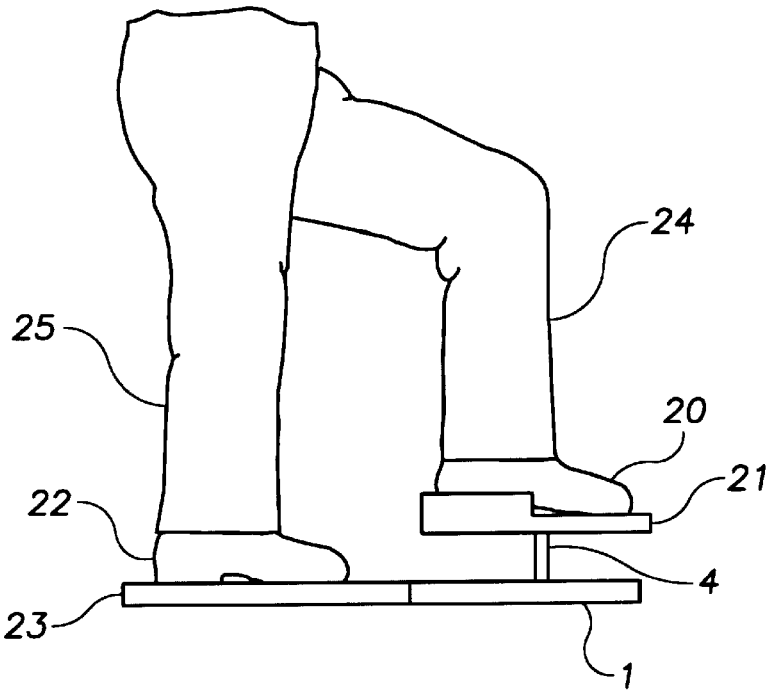
FIG. 4 is a side view illustrating the positioning of the mid delivery training device in use.

FIGS. 3 and 4 illustrate the proper positioning for the mid position training device in actual use by a right handed pitcher. FIG. 3 is a top schematic view illustrating the relative position of the lead foot, 20, in the stirrup, 21. FIG. 4 is a side schematic view illustrating the leg positions. The drive foot, 22, is in contact with, and parallel to, a pitching rubber, 23. The mid position training -device, 1, is positioned such that the lead foot, 20, is parallel to the drive foot, 22 at mid delivery position. The stirrup is positioned to receive the lead foot at a height and distance which allows the pitcher to maintain the lead leg, 24, at a right angle with the upper leg approximately parallel to the ground and the lower leg perpendicular to the ground. The drive leg, 25, should be approximately perpendicular to the ground and straight. By adjusting the mid position training device as shown in FIGS. 3 and 4 the pitcher can stop at the mid delivery position or the pitcher can start at the mid delivery position and practice the follow through motion.

Figure 5A:
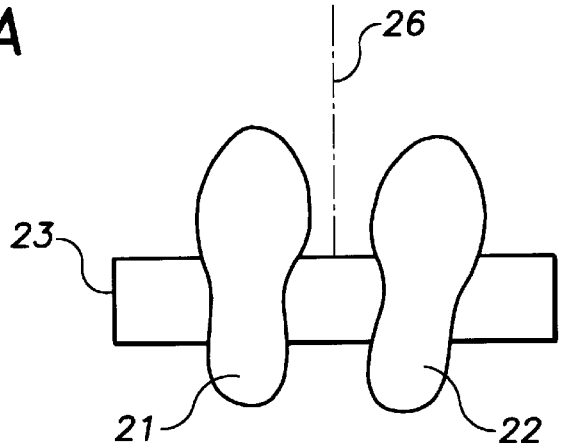
FIG. 5 is a top view illustrating the method of training using the mid delivery training device.
Figure 5B:
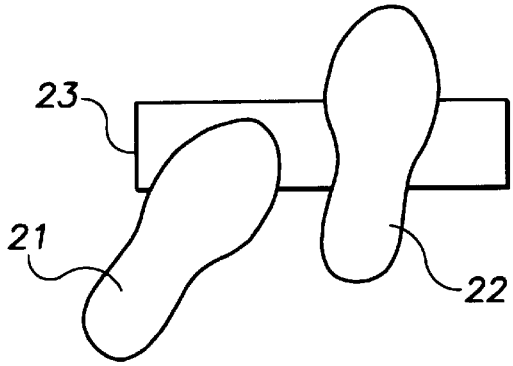
Figure 5C:
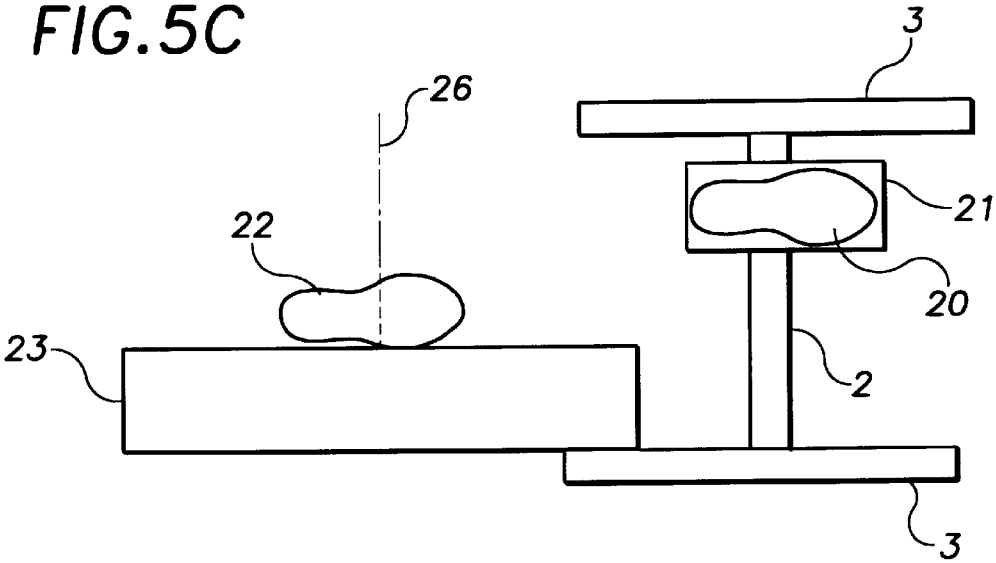

FIG. 5 illustrates the method for using the mid delivery training device for a right handed pitcher. FIG. 5A is the delivery stance or set up position. The lead foot, 20, and drive foot, 22, are parallel and stradle the ball path, 26. To begin the motion the pitcher moves the lead leg back away from the target to a relaxation position with the lead foot still in contact with the pitching rubber as shown in FIG. 5B. The pitcher then rotates on the drive foot and brings the lead foot up and onto the stirrup, 21, of the mid delivery training device as shown in FIG. 5*c*. At this point the ball path should be at the center of the drive foot. From the mid delivery position the pitcher follows through as known in the art.

Figure 6:
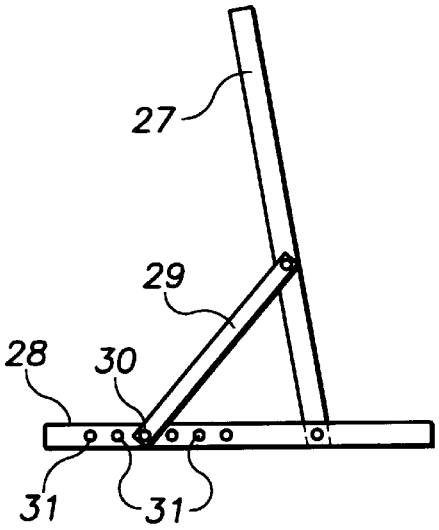
FIGS. 6 and 7 are respectively a side and front view of a target.
Figure 7:
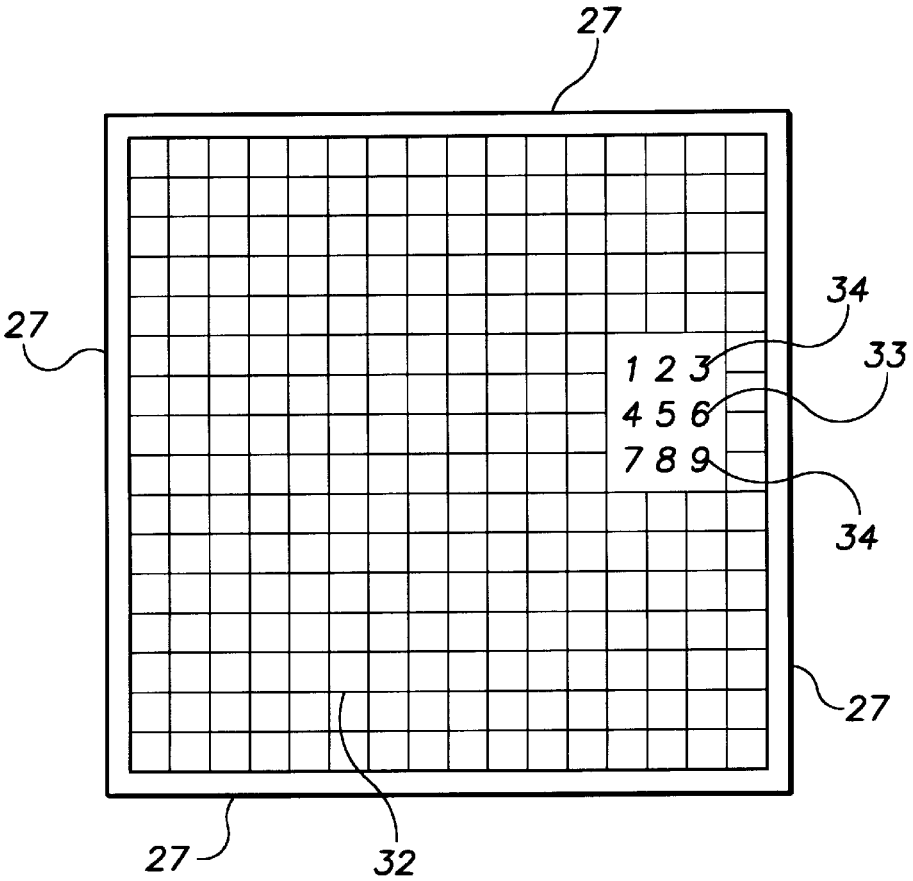

FIGS. 6 and 7 illustrate an additional element of the present invention. FIG. 6 is a side view and FIG. 7 is a front view of a target. The target comprises a tubular rectangular frame, 27, attached to a base, 28. A support member, 29, is pivotally attached to the frame and further attached to the base by alignment of the support hole, 30, with one of the adjustment holes, 31, of the base and inserting a pin, not shown, into the aligned holes. A mesh net, 32, is attached to the frame. The mesh net is sufficiently strong to stop a pitched ball and to rebound the ball back towards the pitcher. The mesh net can be attached to the frame in a number of ways. It can be attached by screws around the periphery, by hook and loop, or the mesh net can be made into a sack and the frame inserted therein. A precision target, 33, can be removably attached by hook and loop or a similar method. The precision target optionally comprises figures, 34, to facilitate score keeping in a variety of games. As a preferred embodiment the ball and precision target can be made of hook and loop material wherein the ball comprises the hook and the target comprises the loop. In this manner the ball can stick to the target to facilitate score keeping.

The material of construction for the structural elements of the mid position training device is not particularly limiting with the proviso that the strength must be sufficient to allow a person to place their weight on the stirrup. The overall weight of the device is also a factor since it should be easily transported. Preferably, the material of construction is a metal such as aluminum or a steel. The base, support arm and stirrup extender are most preferably constructed from square metal tubing since this is suitably strong.

The various fixed elements may be joined by any of the methods known in the art including welding, threaded members, and the like.

The invention has been described and illustrated with emphasis on the preferred embodiments. Other variations and alterations can be envisioned which do not depart from the scope of the invention as set forth in the claims.

What is claimed is:

1. A system for training a baseball pitcher to properly position a drive leg and a lead leg at the middle of the delivery, said system comprising:

a support base;

a vertically adjustable support arm attached to said support base;

a stirrup attached to said vertically adjustable support arm wherein said stirrup is positioned to allow said pitcher to place a lead foot of said lead leg in said stirrup while said lead leg forms a right angle; and a stirrup extender between said vertically adjustable support arm and said stirrup;

with the proviso that said stirrup receives said lead foot of said pitcher and allows said lead foot to slide in direction of a target.

2. The system of claim 1 wherein said stirrup extender comprises an outer extender sleeve and an inner extender sleeve slidably received in said outer extender sleeve.

3. The system of claim 1 wherein said base comprises a parallel base member and at least one base crossmember attached to said parallel base member.

4. The system of claim 3 wherein said vertically adjustable support arm is attached to a collar wherein said collar slidably receives said parallel base member.

5. The system of claim 1 wherein said stirrup comprises a vertical wall.

6. The system of claim 1 wherein said base is at least 12 inches long and no more than 36 inches long.

7. The system of claim 6 wherein said base is at least 20 inches long and no more than 30 inches long.

8. The system of claim 1 wherein said stirrup is at least 3 inches in either direction and no more than 10 inches in either direction.

9. A method for practicing the proper positioning and movement of a lead leg, with an associated lead foot, and a drive leg, with an associated drive foot, while pitching a baseball towards a target comprising the steps of:

a) positioning said lead foot and said drive foot in a parallel relationship on a pitching rubber with both of said lead foot and said drive foot perpendicular to said pitching rubber;

b) moving said lead foot away from said target to a relaxation position;

c) moving to a mid-point position wherein said drive foot is parallel to said pitching rubber and said lead foot is lifted and placed on a mid position training device wherein said mid position training device comprises:

a support base;

a vertically adjustable support arm attached to said support base; and a stirrup attached to said vertically adjustable support arm wherein said stirrup is positioned to allow said pitcher to place a lead foot of said lead leg in said stirrup while said lead leg forms a right angle; and d) bending said drive leg and simultaneously sliding said lead leg towards said target.

10. The method of claim 9 further comprising a stirrup extender between said vertically adjustable support arm and said stirrup.

11. The method of claim 10 wherein said stirrup extender comprises an outer extender sleeve and an inner extender sleeve slidably received in said outer extender sleeve.

12. The method of claim 9 wherein said base comprises a parallel base member and at least one base crossmember attached to said parallel base member.

13. The method of claim 12 wherein said vertically adjustable support arm is attached to a collar wherein said collar slidably receives said parallel base member.

14. The method of claim 9 wherein said base is at least 12 inches long and no more than 36 inches long.

15. A system for training a baseball pitcher a proper motion for a drive leg and a lead leg while pitching a baseball, said system comprising:

a target comprising a rectangular frame;

a support member attached to said frame;, and a mesh net attached to said rectangular frame; and a mid position training device comprising:

a support base;

a vertically adjustable support arm attached to said support base;

a stirrup attached to said vertically adjustable support arm wherein said stirrup is positioned to allow said pitcher to place a lead foot of said lead leg on said stirrup, while said lead leg forms a right angle;

with the proviso that said stirrup receives said lead foot of said pitcher and allows said lead foot to slide in direction of a target.

16. The system of claim 15 wherein said base is at least 20 inches long and no more than 30 inches long.

17. The system of claim 15 further comprising a precision target removably attached to said mesh net.

18. The system of claim 15 wherein said stirrup comprises a vertical wall.

19. The system of claim 15 wherein said stirrup is at least 3 inches in either direction and no more than 10 inches in either direction.

* * * * *